United States Patent [19]

Kallmeyer

[11] 4,095,619

[45] Jun. 20, 1978

[54] YARN INSERTING AND PACKING MACHINE

[75] Inventor: Albert W. Kallmeyer, St. Louis County, Mo.

[73] Assignee: McDonnell Douglas Corporation, St. Louis, Mo.

[21] Appl. No.: 786,455

[22] Filed: Apr. 11, 1977

[51] Int. Cl.[2] ..... D03D 35/00

[52] U.S. Cl. ..... 139/22; 139/140; 139/141

[58] Field of Search ..... 139/11, 20, 21, 22, 139/23, 135, 136, 137, 139, 140, 141

[56] References Cited

U.S. PATENT DOCUMENTS

| | | | |
|---|---|---|---|
| 708,252 | 9/1902 | Barbier | 139/137 |
| 3,391,714 | 7/1968 | Quintana | 139/20 |
| 3,818,951 | 6/1974 | Greenwood | 139/20 |
| 3,834,424 | 9/1974 | Fukuta | 139/20 |
| 4,019,540 | 4/1977 | Holman et al. | 139/20 |
| 4,041,988 | 8/1977 | Benzakein | 139/116 |

*Primary Examiner*—Henry S. Jaudon

*Attorney, Agent, or Firm*—Gravely, Lieder & Woodruff

[57] ABSTRACT

A machine for inserting cross yarns through an array of longitudinal yarns so as to produce a three-dimensional weave includes yokes positioned adjacent to the array of longitudinal yarns and two rotatable shafts mounted on each yoke along opposite sides of the array with the shafts extended generally perpendicular to the direction of the longitudinal yarns. The shafts of each yoke at their ends have latching mechanisms which are capable of individually engaging and releasing a transfer arm having sufficient length to span the space between shafts. The shafts of each yoke when rotated are capable of moving the transfer arm between end positions wherein the arm is located entirely to the side of the array and a traversing position wherein the arm extends through the array and is engaged with the two shafts. Thus, by rotating the shafts and operating the latching mechanisms it is possible to pass the transfer arm completely through the array from one end position to the other. The transfer arm carries a spool of weaving yarn which pays out from the free end of a yarn laying arm that is pivotally connected to the transfer arm intermediate its ends. As the transfer arm moves from one end position to the traversing position, the free end of the laying arm swings from one end position to the other and lays the weaving yarn through the array of longitudinal yarns to form a cross yarn. The transfer arm is used to pack the most recently laid cross yarn against previously inserted cross yarns by moving the yoke in the direction of the longitudinal yarns with the transfer arm in its traversing position. Means exist for moving the yoke perpendicular to the longitudinal yarns so that another cross yarn may be passed through a different portion of the array of longitudinal yarns.

18 Claims, 8 Drawing Figures

FIG. 3
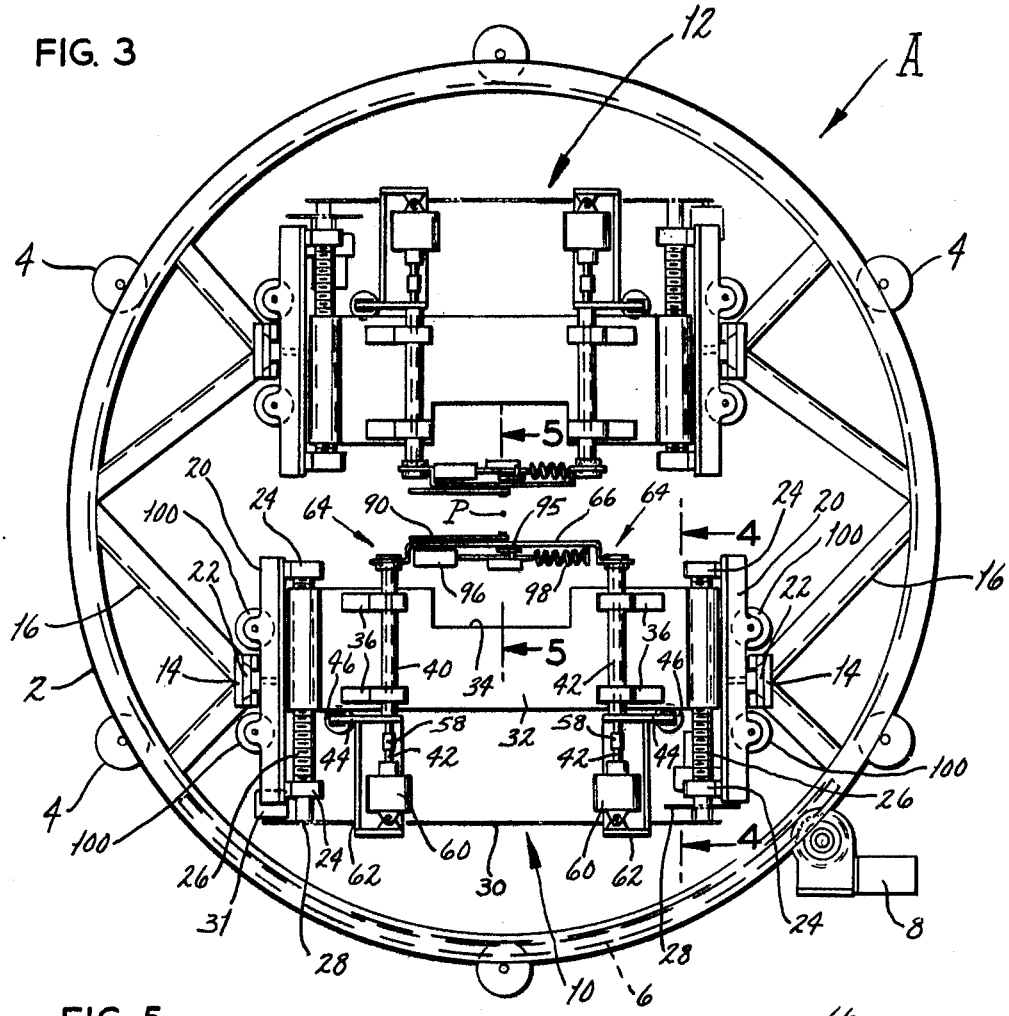
FIG. 5
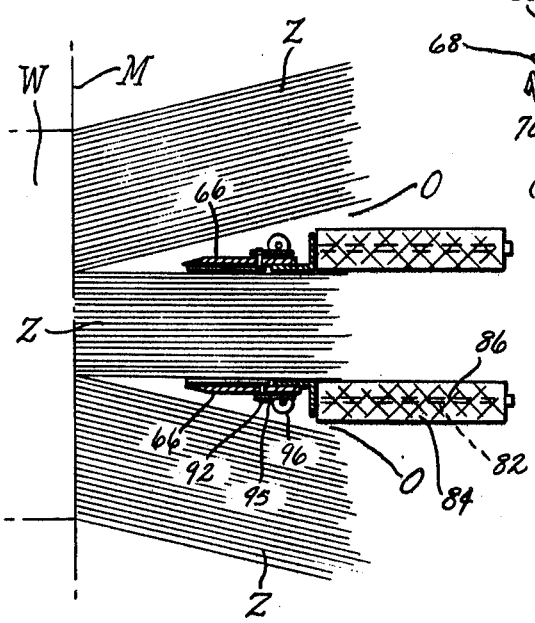
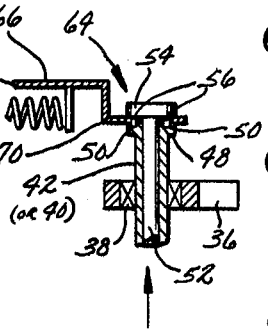
FIG. 6
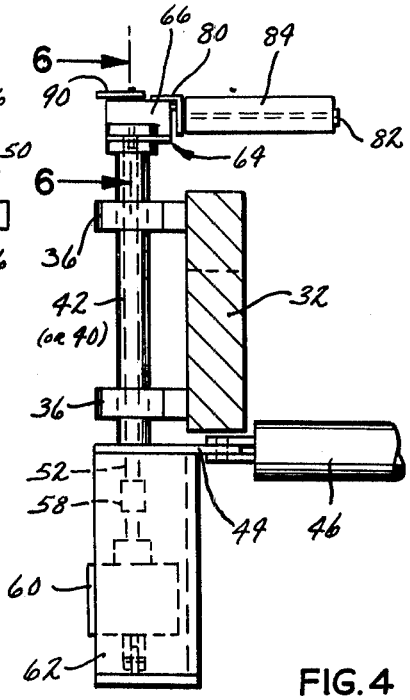
FIG. 4

YARN INSERTING AND PACKING MACHINE

BACKGROUND OF THE INVENTION

This invention relates in general to weaving and more particularly to a machine for inserting yarn through an array of longitudinal yarns to produce a three-dimensional weave.

Three-dimensional weaves, in contrast to conventional two-dimensional weaves which are most commonly associated with fabrics, have substantial thickness by reason of the fact that the yarns which make up the weave extend in three directions. Comparing the weave with a cartesian coordinate system, some of the yarns extend in the X direction, more of the yarns extend in the Y direction, and still more extend in the Z direction. The individual strands of X and Y yarns may be woven through the parallel strands Z yarns, thus creating the weave. These weaves when impregnated with suitable resins or graphitic materials product extremely light weight and strong composite structures which are useful in the aerospace industry as well as other industries. Moreover, when the yarns are of the ablative variety, such as high modulus carbon or graphite, the composite structure is capable of withstanding extremely high temperatures.

Heretofore, three-dimensional weaves have been produced using procedures requiring a substantial amount of manual labor. As a result, these procedures are extremely tedious and time-consuming. For example, one procedure involves pushing hollow needles through stacked layers of previously woven cloth and inserting yarn of the third direction through these needles. Furthermore, current weaving procedures subject the yarn to substantial shear forces, but ablative yarns have very low shear strength in spite of their high tensile strength, and consequently, the yarns often sever during weaving, thus further delaying the process.

U.S. patent application Ser. No. 666,241, of H. A. Holman, A. W. Kallmeyer, H. C. Paulsen, and W. W. Weaver, filed Mar. 12, 1976, now U.S. Pat. No. 4,019,540, discloses a Loom for Producing Three Dimensional Weaves, but this application is concerned primarily with producing shed openings in an array of longitudinal yarns so that cross yarns may be inserted through the shed openings in two directions to create a three-dimensional weave. The loom is ideally suited for use with ablative yarns since it does not impose excessive shear stresses on the yarns. However, the patent does not show an apparatus for automatically inserting yarn through the shed openings in the longitudinal yarns.

SUMMARY OF THE INVENTION

One of the principal objects of the present invention is to provide a machine for automatically inserting a cross yarn through an array of longitudinal yarns so as to produce a three-dimensional weave. Another object is to provide a machine of the type stated which is ideally suited for use with high modulus or ablative yarns in that it does not subject those yarns to excessive abrasion or shear forces. A further object is to provide a machine of the type stated which is ideally suited for use in conjunction with the loom of U.S. patent application Ser. No. 666,241, filed Mar. 12, 1976. An additional object is to provide a machine which not only inserts the yarn, but also packs it into the weave, all in one operation. Still another object is to provide a machine of the type stated which places each cross yarn into the shed opening very close to the position that it finally assumes so that the packing operation requires very little movement. Yet another object is to provide a machine of the type stated in which the bobbin for weaving the cross yarns is always attached to the machine and is not propelled through the array of longitudinal yarns as is a flying shuttle. A further object is to provide a machine of the type stated which is simple in construction and reliable in operation. These and other objects and advantages will become apparent hereinafter.

DESCRIPTION OF THE DRAWINGS

In the accompanying drawings, which form part of the specification and wherein like numerals and letters refer to like parts wherever they occur:

FIG. 3 is a front elevational view of the inserting and packing machine, the view being taken along line 3—3 of FIG. 1;

FIG. 4 is a sectional view taken along line 4—4 of FIG. 3 and showing one of the rotatable shafts;

FIG. 5 is a sectional view taken along line 5—5 of FIG. 3 and showing the transfer arms in shed openings formed in the array of longitudinal yarns;

FIG. 6 is a fragmentary sectional view taken along line 6—6 of FIG. 4 and showing one of the latching mechanisms;

DETAILED DESCRIPTION

Figure 1:
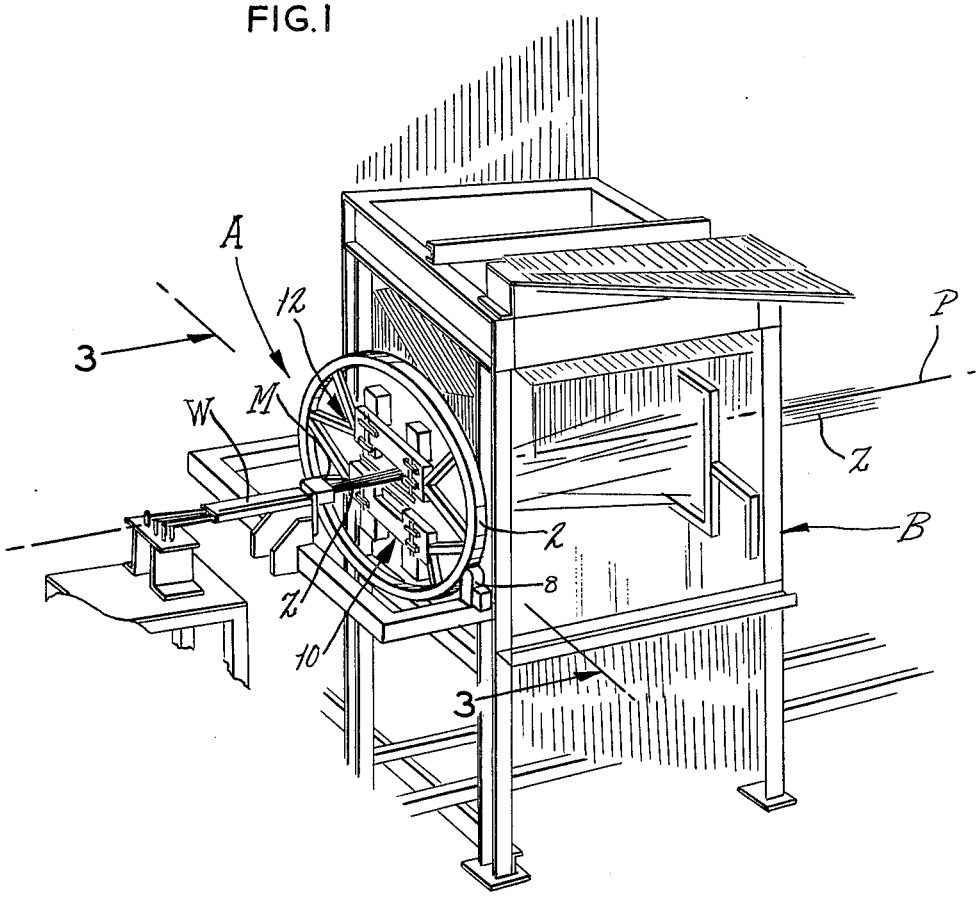
FIG. 1 is a perspective view of the inserting and packing machine of the present invention installed on a loom which creates shed openings in an array of longitudinal yarns.
Figure 8:
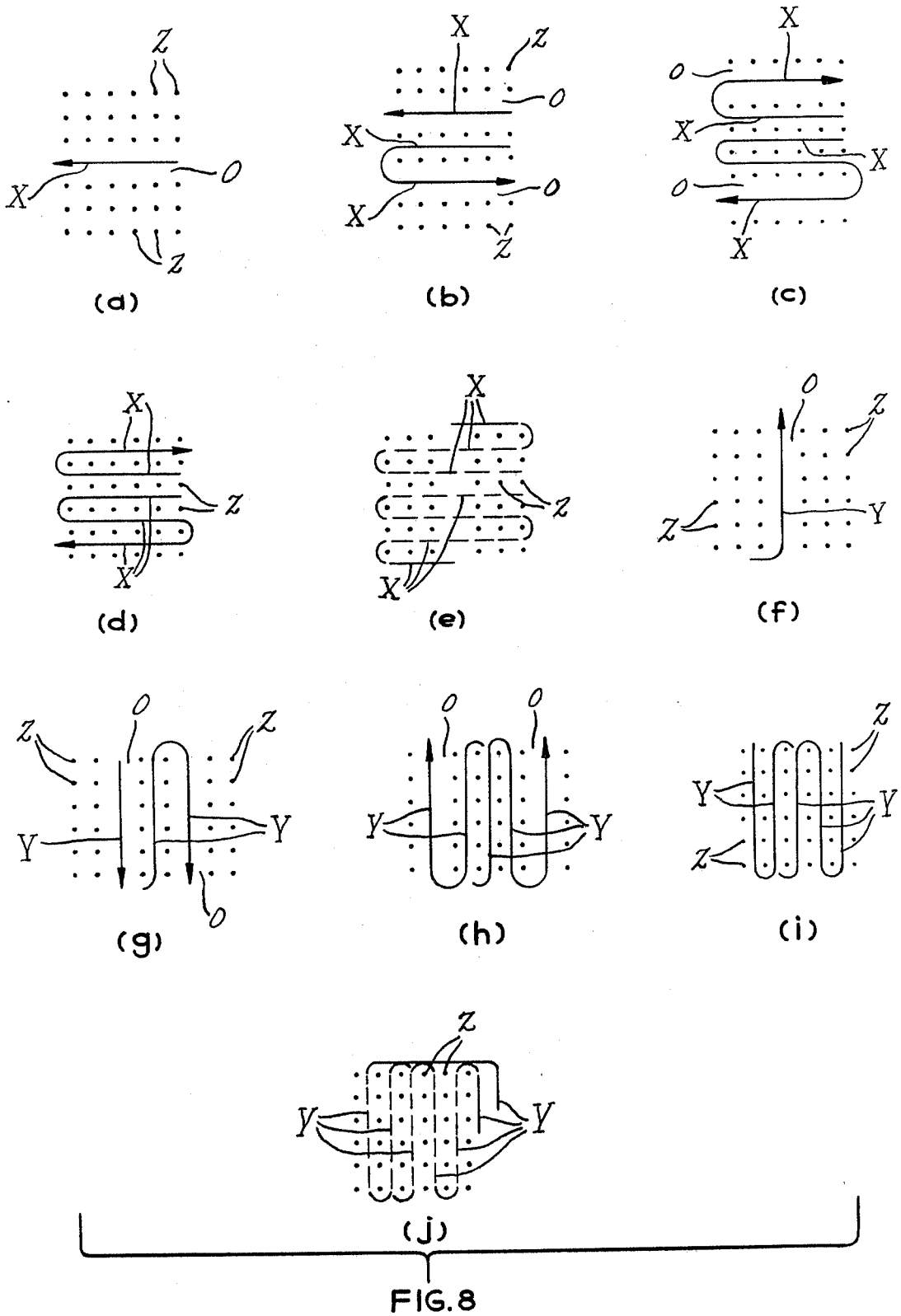
FIG. 8 is a sequence of sectional views of the weave along a plane parallel to the weaving plane and showing the various horizontal and vertical cross yarns as they are laid through the array of longitudinal yarns.

Referring now to the drawings, A designates a yarn inserting machine (FIG. 1) which is used in conjunction with a loom B for producing three-dimensional weave W (FIG. 2) in a highly automated manner. The weave W is composed of yarns having three different orientations, namely longitudinal yarns Z, cross yarns X, and more cross yarns Y. The cross yarns X and Y are oriented at 90° with respect to each other and are woven through the yarns Z which are by far the longest yarns in the weave. Generally, the cross yarns X extend horizontally while the cross yarns Y extend vertically, and hence the yarns X and Y correspond to the similarly designated axes of a two-dimensional cartesian coordinate system. The yarns Z, moreover, correspond in direction to the Z axis of a three-dimensional cartesian coordinate system. Since all of the yarns X, Y, and Z are oriented at 90° with respect to each other, the weave W may be characterized as an orthogonal weave. Generally speaking, the loom B arranges the longitudinal yarns Z in an array composed of a series of horizontal and vertical rows with the yarns Z of any row being parallel (FIG. 8). The loom L has the capability of moving the various horizontal and vertical rows to create shed openings O in the array (FIGS. 5 and 8).

Each shed opening O is nothing more than an enlarged space between two adjacent rows of yarns Z in the array and it may exist between horizontal rows of yarn Z or vertical rows of yarn Z. At the front of each shed opening O, the longitudinal yarns Z which bound it converge toward an apex. The inserting machine A lays a cross yarn X or a cross yarn Y in the shed opening O to produce the three-dimensional weave W. The loom disclosed in U.S. patent application Ser. No. 666,241, filed Mar. 12, 1976, now U.S. Pat. No. 4,019,540, is ideally suited for use with the inserting machine A.

The inserting machine A is installed on the loom L and surrounds the array of longitudinal yarns Z in the vicinity of a weaving plane M, that is at the location of the most recently inserted and packed yarn X or Y. The machine A includes (FIG. 3) a circular frame 2 positioned on rollers 4 such that the center of frame 2 coincides with the longitudinal axis P of the array of longitudinal yarns Z. The rollers 4 permit the circular frame 2 to rotate, but otherwise confine it. Along its periphery, the frame 2 has a gear segment 6 which meshes with a pinion gear on a reversible gearhead motor 8. The segment 6 is long enough to enable the motor 8 to rotate the frame 2 90° on its rollers 4. The frame 2 carries two inserter and packer units 10 and 12 which are virtually identical, with each one occupying a different half of the frame interior.

Since the inserter and packer units 10 and 12 are practically identical, only the unit 10 will be described in detail. That unit is supported on a pair of slideways 14 (FIG. 3) which extend through the frame 2 parallel to the frame axes, that is in the direction of the longitudinal yarns Z, and the slideways 14 in turn are anchored to the frame 2 by V-shaped brackets 16. The inserter and packer unit 10 itself spans the space between the two slideways 14 and includes two sidebars 20, each of which is provided with a slide 22 that is received in one of the slideways 14. The bars 20 extend crosswise with respect to their slides 22 and are located slightly inwardly from them. Each bar 20 at its ends has bearing blocks 24 provided with a bearing through which a lead screw 26 extends, and this lead screw 26 beyond the one end of the bar 20 is fitted with a sprocket 28. The lead screws 26 for the two bars 20 are connected together through a chain 30 which enables the screws 26 to rotate in unison and at the same angular velocity. The chain 30 is powered by a motor 31 mounted on one of the bars 20.

The two lead screws 26 thread through the opposite ends of a common yoke 32 so that when the lead screws 26 are rotated in one direction the yoke 32 will move toward the longitudinal axis P, and when they are rotated in the opposite direction the yoke 32 will move away from the axis P. Thus, the lead screws 26 move the yoke 32 at right angles to the direction of the slideway 14. The yoke 32 is relieved between its ends to provide a cutout 34 capable of receiving the outermost yarns Z of the array when the yoke 32 is located close to the array. Bolted to the yoke 32 on each side of the cutout 34 are a pair of bearing blocks 36 having bearings 38 fitted into them, and extended through the bearings on the one side of the yoke 32 is a rotatable quill shaft 40, and likewise extended through the bearing 38 on the other side of the yoke 2 is another rotatable quill shaft 42 (FIGS. 3 and 4). The two quill shafts 40 and 42 are parallel to one another and to the lead screws 26. Preferably the bearings 28 are of the tapered roller variety, with the two bearings 38 for each shaft 40 and 42 being mounted in opposition and adjusted to a condition of slight preload. This enables the shafts 40 and 42 to rotate easily without end or radial play. Each quill shaft 40 and 42 at its rear end, that is the end presented toward the frame 2, is fitted with a crank arm 44, and each crank arm 44 in turn is connected with an air cylinder 46 mounted on the yoke 32. The arrangement is such that when the air cylinder 46 for a shaft 40 and 42 is energized, it will rotate its shaft 40 or 42 through an arc of 90°.

At its forward end each quill shaft 40 or 42 has a flange 48 (FIG. 6) provided with a pair of forwardly opening latching holes 50 which are spaced 180° apart. Extended through the hollow interior of each quill shaft 40 and 42 is a center latching shaft 52 which is keyed or splined to its quill shaft 40 or 42 so that the center shaft 52 cannot rotate independently of its quill shaft 40 or 42. The center shaft 52 at its forward end is provided with a flange 54 which overlies the flange 48 on the quill shaft 40 or 42, and the flange 54 has a pair of latching pins 56 which align with the latching holes 50. Indeed, when the center shaft 52 is in its rearmost position, the latching pins 56 are received in the holes 50 of the underlying flange 48. The center shaft 52 is capable of moving forwardly a distance sufficient to completely free the latching pins 56 from the holes 46, with the forward movement being limited by a stop collar 58 (FIGS. 3 and 4) located beyond the rear end of the quill shaft 40 or 42. Beyond, the stop collar 58, the center shaft 52 is connected with an air cylinder 60 which is mounted in a housing 62 attached to the crank arm 44 for the quill shaft 40 or 42. This enables the air cylinder 60 to rotate with quill shaft 40 and 42 and the center shaft 52 to which it is attached. The center shaft 52 is normally located in its rearmost position, in which case the pins 56 are in the latching holes 50, but when the air cylinder 56 is energized, the shaft 52 moves forwardly and the latching pins 56 withdraw from the holes 50. The two flanges 48 and 54, together with their holes 50 and pins 56, and the center shaft 52 with which they are associated, constitute a latching mechanism 64 for the quill shaft 40 or 42.

The two quill shafts 40 and 42 manipulate a transfer arm 66 (FIGS. 3 and 7) and in effect pass the arm 66 back and forth between them. As the arm 66 moves back and forth it passes through different shed openings O in the array of longitudinal yarns Z. The transfer arm 66 is long enough to bridge the intervening space between the forward ends of the two latching mechanisms 64 and is engaged and released at its ends by those mechanisms 64. More specifically, the transfer arm 66 has a straight midportion 68 and end portions 70 which are offset rearwardly from the midportion 68. The end portions 70 in turn have U-shaped cutouts 72 (FIG. 7*a*) which are configured to fit around the end portions of the center shafts 52 at the latching mechanisms 64 thereon. Each end portion 70 further has a pair of apertures 74 which align with the holes 46 and likewise receive the latching pins 56.

The quill shafts 40 and 42 move the arm 66 between three positions, namely a traversing position (FIG. 7*c*), and two end positions (FIGS. 7*a* and *e*). In the traversing position, the transfer arm 66 extends through the array of longitudinal yarns Z perpendicular thereto and is connected to both of the quill shafts 40 and 42 at their respective latching mechanisms 64. Indeed, the traversing position may be considered an intermediate position through which the arm 66 must pass before assuming either of the end positions. To reach the first end position, the air cylinder 60 for the quill shaft 42 is energized and it drives the center shaft 52 forwardly to release the latching mechanism 64 for the shaft 42. In other words, the air cylinder 60 withdraws the latching pins 60 from the holes 48 and the apertures 74 at the forward end of the quill shaft 42 so as to release the transfer arm 66 from the quill shaft 42. Next, the air cylinder 46 for the quill shaft 40 is pressurized. This rotates the quill shaft 40 as well as the transfer arm 66 which is connected to it at the latching mechanism 64 for the shaft 40. The rotation continues for 90°. The transfer arm 66 accordingly assumes its first end position in which it is located to the side of the array of longitudinal yarns z and is disposed parallel to the center axis P.

To reach the second end position, the transfer arm 66 is brought back to its traversing position by energizing the rotating cylinder 46 for the shaft 40 in the opposite direction and then the latching cylinder 60 for the shaft 42, also in the opposite direction. The latter causes the latching mechanism 64 on the shaft 42 to engage the end portion of the arm 66. Thereafter, the latching cylinder 60 for the shaft 40 is pressurized to release the other end of the arm 66 for the latching mechanism 64 engaged with it, that is from the latching mechanism 64 on the shaft 40. Then the cylinder 46 for the shaft 42 is pressurized to rotate the shaft 42 90° and bring the arm 66 to the other end position, in which case it is again disposed parallel to the center axis P, but is on the opposite side of the array of longitudinal yarns Z. The transfer arm 66 is returned to its traversing position through the reverse of the foregoing sequence.

Figure 7:
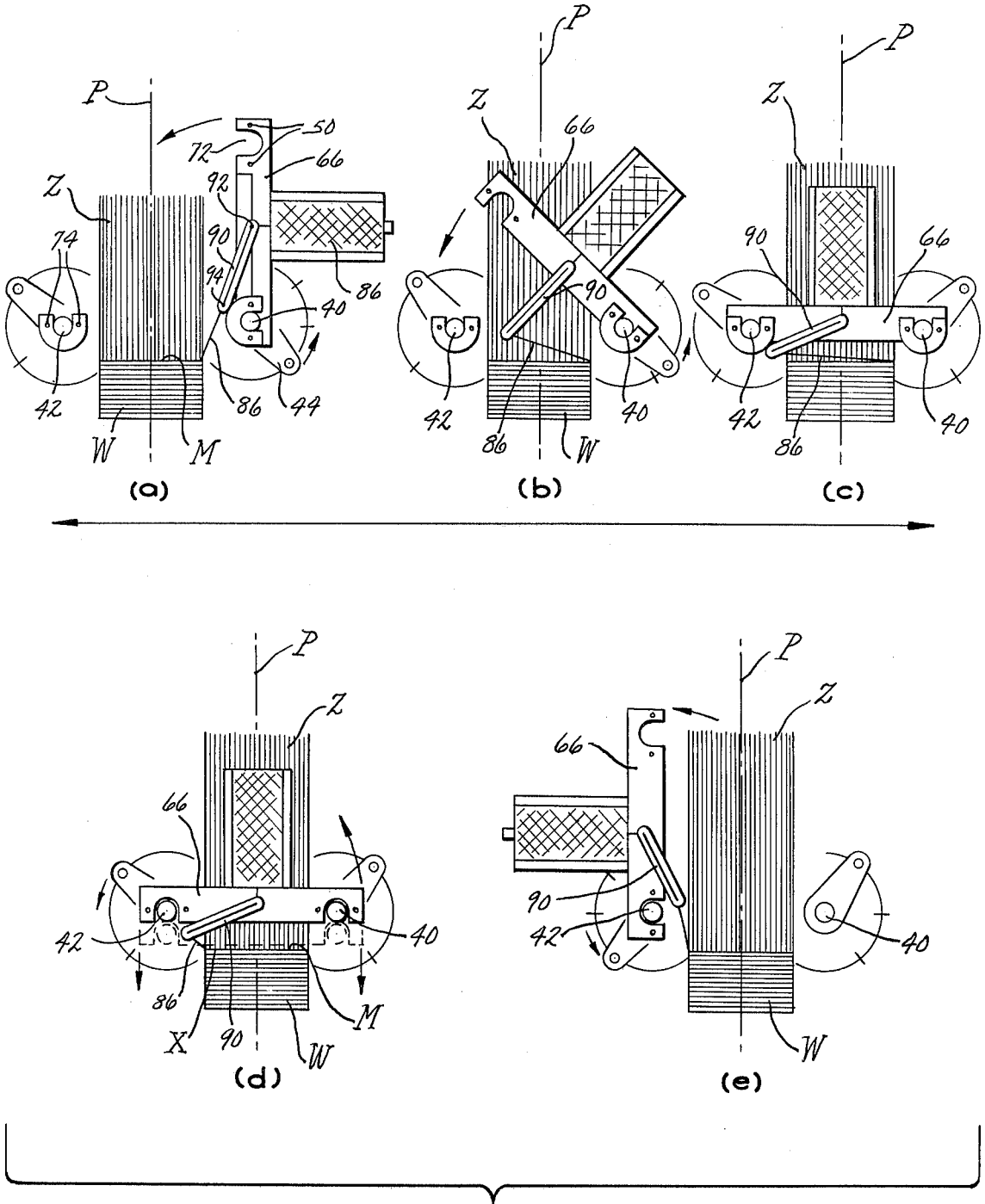
FIG. 7 is a sequence of end views showing the transfer and yarn laying arms in the various positions assumed by those arms as the transfer arm is passed back and forth through the array of longitudinal yarns.

The transfer arm 66 midway between its ends is fitted with a carrier bracket 80 (FIGS. 4 and 5) that projects toward the yoke 32, and this bracket has a spindle 82 mounted on it such that it is oriented perpendicular to the longitudinal axis of the transfer arm 66. The spindle 82 holds a bobbin or spool 84 having weaving yarn 86 wound about it, and this yarn is suitable from both the cross yarns X and the cross yarns Y. The yarn 86 that pays off of the spool 84 passs through a guide aperture in the bracket 80 and then along a yarn laying arm 90 (FIG. 7) which is fitted to a pivot pin 92 that rotates in the transfer arm 66 midway between the ends of the arm 66. The yarn laying arm 90 is slightly less than one-half the length of the transfer arm 66, and when the arm 90 lays along the transfer arm 66, it is long enough to project beyond the endmost row of longitudinal yarns Z. While one end the yarn laying arm 90 is connected to the transfer arm 66, the oposite end is free, so that when the arm 90 pivots relative to the arm 66, the free end of the laying arm 90 is capable of moving from one end of the transfer arm 66 to the other end of the arm 66. The free end of the yarn laying arm 90 has an aperture 94 through which the yarn 86 passes (FIG. 7*a*).

The pivot pin 92 extends completely through the transfer arm 66 and at its opposite end is provided with a crank arm 95 (FIGS. 3 and 5). Thus, the laying arm 90 lies along one face of the transfer arm 66, while the crank arm 95 lies along the other. On one side of the crank arm 95, the transfer arm 66 is fitted with a linear actuator 96 (FIG. 3) which connects with crank arm 95 beyond the pivot pin 92. The linear actuator 96 may be a solenoid, an air cylinder, or similar device. The linear actuator 96, when energized rotates the laying arm 90 to a position in which the laying arm 90 generally lies along the transfer arm 66 and its free end is adjacent to that end of the transfer arm 66 which couples with the quill shaft 40. In addition to the linear actuator 96, the transfer arm 66 is fitted with a spring 98 which acts on the crank arm 95 in opposition force exerted by the linear actuator 96, but the actuator 96 when energized is capable of overcoming the spring 98. Thus, when the linear actuator 96 is not energized, the spring 98 will move the laying arm 90 to a position in which it likewise lies along the transfer arm 66, but its free end is located adjacent to the opposite end of the transfer arm 66.

The yoke 32, and along with it the transfer arm 66, are moved in the direction of the yarns Z by air cylinders 100 which are connected between side bars 20 and the circular frame 2. This causes the slides 22 to move along their respective slideways 14. As the transfer arm 66 moves it passes between two vertical or horizontal rows of yarns Z, or more accurately, through a shed opening O formed in the array of longitudinal yarns Z. To enable the arm 66 to move up to the weaving plane M without deflecting the longitudinal yarns Z excessively, that edge of the arm 66 which is presented toward the weaving plane is beveled. The movement afforded by the slides 22 and slideways 14 and imparted by the air cylinders 100 enables a yarn X or Y that has been inserted through a shed opening O to be packed into the previously woven portion of the weave W to extend the weave W still further.

The air cylinders 46, 60 and 100, the motors 8 and 31, and the linear actuators 95 are preferably controlled by a computer which likewise controls the operation of the loom B, so that the loom B and inserting machine A operate in the proper sequence to create the weave W. The cylinders 46, 60 and 100, the motors 8 and 31, and the actuators 95 may, however, be operated manually by manipulating valves, switches, and similar controls.

OPERATION

A typical weave W is normally started by creating a single shed opening O at the center of the array of longitudinal yarns Z and passing a single horizontal yarn X through that opening (FIG. 8*a*). The shed opening is then closed upon the yarn X and two more shed openings O are formed along the two horizontal rows of yarns Z between which the single yarn X is captured. In this regard, the loom B has the capability of creating two shed openings O at a time, one at each inserter and packer unit 10 and 12. Another horizontal yarn X is inserted through one of the shed openings O while the original yarn X is doubled back upon itself through the other shed opening X, creating another cross yarn X (FIG. 8*b*). Thereupon, the two horizontal rows of longitudinal yarns Z which formed the outside of the opening O are moved inwardly so as to now form the inside of the next shed opening O. This captures the previously laid cross yarn X tightly in the weave W. Thereupon, the two cross yarns X are doubled back upon themselves and passed through the shed openings forming still more cross yarns X (FIG. 8*c*). The procedure continues with the shed opening O moving progressively further away from the axis P (FIGS. 8*d* & 8*e*).

When the last horizontal row of longitudinal yarns X is laid, the same procedure is repeated in the vertical direction, that is a single cross yarn Y is laid through a single shed opening O located between the two centermost vertical rows of longitudinal yarns Z (FIG. 8*f*), and thereafter the vertical shed openings O are moved progressively outwardly while the cross yarns Y are laid through them (FIGS. 8*g–j*).

The foregoing weaving sequence is achieved with the inserting machine A operating in conjunction with the loom B. The loom B creates the shed openings, while the inserting machine A lays cross yarns X or Y through the shed openings and packs them in place. Where two shed openings exist in the array of longitudinal yarns Z, as is normally the case, the inserter and packer unit 10 lays a cross yarn X or Y through the one, while the inserter and packer unit 12 lays another cross strand X or Y through the other (FIG. 5).

Since the inserter and packer units 10 and 12 operate the same, only the operation of the unit 10 will be discussed in detail. The transfer arm 66 of the unit 10 is initially in its first end position where both it and the yarn laying arm 90 on it are located to the side of the array of longitudinal yarns Z (FIG. 7*a*). Moreover, the yoke 32 is positioned such that the leading edge of the transfer arm 66 is backed off from the weaving plane M and the transfer arm 66 itself lies in a horizontal plane which passes adjacent to the center axis P of the longitudinal array. This position is obtained by leaving the air cylinders 100 in their retracted positions and turning the lead screws 26 to bring the transfer arm 66 to its innermost position. The loom B is activated to create a horizontal centrally disposed shed opening O. The end of weaving yarn 86 is then secured to the loom B adjacent to the transfer arm 66 so that the secured end of the yarn 86 is located at the same side of the array of longitudinal yarns Z as the transfer arm 66 and yarn laying arm 90.

With the arms 66 and 90 so disposed and the end of the weaving yarn 86 anchored, the air cylinder 46 for quill shaft 40 is pressurized and rotates the shaft 40 90°. The shaft 40 swings the transfer arm 66 through the center shed opening (FIG. 7*b*) until the U-shaped cutout 72 on the unattached end passes over the quill shaft 42 (FIG. 7*c*). In other words, the arm 66 moves into its traversing position where it is extended through the shed opening O. As the arm 66 swings to its traversing position, the linear actuator 96 is energized and it causes the yarn laying arm 90 to swing relative to the transfer arm 66. The movement of the laying arm 90 is sufficient to bring its free end all the way through the shed opening O so that when the transfer arm 66 reaches its traversing position, the free end of the laying arm 90 is located on the opposite side of the array of longitudinal yarns Z adjacent to the quill shaft 42. The weaving yarn 86, being threaded through the aperture 94 in the free end of the laying arm 90, likewise extends through the shed opening 0 and forms the first cross yarn X of the weave W.

Once the transfer arm 66 reaches its traversing position, the air cylinder 60 along the quill shaft 42 is retracted to engage the latching mechanism 64 for that shaft. This brings the latching pins 56 into the apertures 74 in the transfer arm 66 and also into the holes 50 in the flange 48 of the quill shaft 42. Next the air cylinders 100 are pressurized to drive the entire yoke 32 toward the weaving plane M (FIG. 7*d*). As a result the transfer arm 66 moves through the shed opening O parallel to the longitudinal yarns Z and its beveled leading edge bears against the recently inserted cross yarn X and gently pushes it up to the weaving plane M. Thereupon the air cylinders 100 are energized in the opposite direction to retract the transfer arm 66 to its initial traversing position. Finally the traversing arm 66 is moved to its other end position (FIG. 7*e*), this being achieved by releasing the latching mechanism 64 on the shaft 40 and energizing the air cylinder 46 for the shaft 42 so that the quill shaft 42 rotates. This completes the insertion of the first cross yarn X.

After the transfer arm 66 reaches its end position on the shaft 42 (FIG. 7*e*), the loom B changes the position of the shed opening and will normally create two shed openings spaced equally from the center axes P. The lead screw 26 for the inserter and packer unit 10 is rotated to align the transfer arm 66 with the new shed opening O. Thereupon the air cylinder 46 for the quill shaft 42 is energized, and it rotates the quill shaft such that the transfer arm 66 which is latched to it moves through the shed opening O to its traversing position, and upon reaching that position the air cylinder 60 for the shaft 40 is energized to operate its latching mechanism 64 and secure the quill shaft 40 to the transfer arm 66. As the transfer arm 66 moves through the shed opening O the linear actuator 96 is de-energized. As a result the spring 98 rotates the laying arm 90 about the axis of its pivot pin 92, causing the free end of the yarn laying arm 90 to swing from a position adjacent to the shaft 42 to a position adjacent to the shaft 40. In so doing it carries the weaving yarn 86 through the shed opening O, to create another cross yarn X. Since the position of the shed opening O was changed between the first and second passages of the transfer arm 66 through the array of longitudinal yarns Z, the weaving yarn 86 wraps around the end-most longitudinal yarn Z in the row of longitudinal yarns Z which separates the shed opening O from the position of the previous shed opening O. Then the air cylinders 100 are again pressurized to pack the cross yarn X into the weaving plane. As the inserter and packer unit 10 lays its weaving yarn 86 through the one shed opening O, the inserter and packer unit 12 lays another cross yarn X through the other shed opening O so that two cross yarns X are inserted simultaneously (FIG. 5).

The loom B produces shed openings O beyond each successive row of longitudinal yarns Z, and the inserter and packer units 10 and 12 lay their respective weaving yarns 86 through the shed openings to create additional cross yarns X (FIG. 8).

After the last horizontal shed opening O has received its cross yarn X, the gear head motor 8 is energized to rotate the circular frame 90°. The same procedure is repeated to provide a plane of Y yarns. After the yarns Y are in place, the frame 2 is rotated back to its initial position and another plane of yarns X is laid. The procedure is repeated with alternate planes of yarns X and Y until the weave W reaches the desired length (FIG. 8).

Figure 2:
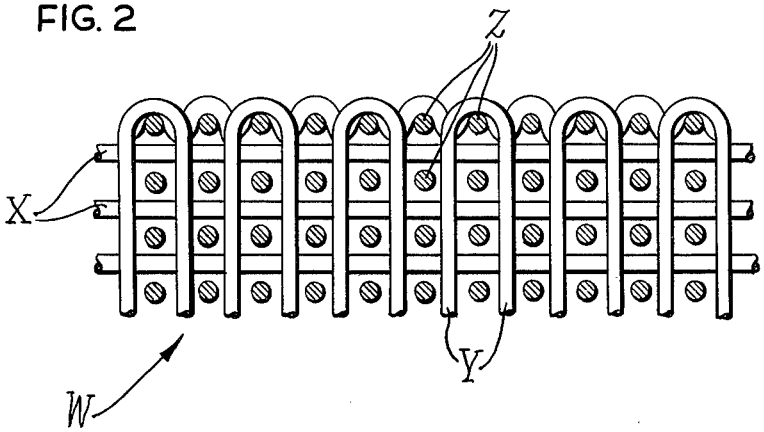
FIG. 2 is a sectional view of a typical weave formed by the machine.

The pattern of the weave which is formed need not necessarily be the weave illustrated in FIGS. 2 and 8. On the contrary, a wide variety of weaves are possible, with the particular weave pattern being dependent on the various positionings effected by the motors 8 and 31 and the sequence in which the cylinders 46, 60 and 100 are operated in conjunction with the loom B.

This invention is intended to cover all changes and modifications of the example of the invention herein chosen for purposes of the disclosure which do not constitute departures from the spirit and scope of the invention.

What is claimed is:

1. A machine for inserting cross yarns through an array of longitudinal yarns, said machine comprising: a transfer arm longer than the width of the array and having a supply of weaving yarn on it with the yarn being suitable for use as the cross yarns; first and second support means capable of engaging and releasing the transfer arm, each of the support means further being capable of rotating the transfer arm such that the transfer arm passes through the array and is transferred from the first means to the second means and vice-versa, with the rotation being about an axis located to the side of the array, the first means being capable of supporting the arm at an end position beyond one side of the array and the second means being capable of supporting the arm at another end position beyond the other side of the array; a yarn laying arm pivotally connected to the transfer arm and having a free end through which the weaving yarn passes; and actuating means for causing the yarn laying arm to rotate relative to the transfer arm as the transfer arm is transferred between the first and second support means, with the rotation being such that the free end of the yarn laying arm moves from the end position at which the transfer arm is initially located to the end position to which the transfer arm is transferred after passing through the array of longitudinal yarns, whereby the weaving yarn is laid through the array to form a cross yarn therein.

2. A machine according to claim 1 wherein the transfer arm is long enough to be engaged by both the first and second means at the same time and when the transfer arm is so engaged it extends through the array of longitudinal yarns.

3. A machine according to claim 1 wherein laying arm rotates relative to the transfer arm about an axis which is generally perpendicular to the direction of the longitudinal yarns.

4. A machine according to claim 3 wherein the laying arm rotates about an axis which is parallel to the axis about which the transfer arm is rotated by the support means.

5. A machine for inserting cross yarns through an array of longitudinal yarns, said machine comprising: a transfer arm longer than the width of the array and having a supply of yarn on it with the yarn being suitable for use as the cross yarns; and first and second support means capable of engaging and releasing the transfer arm and cooperating to transfer the arm between said means such that the arm passes through the array as it is transferred from the first means to the second means and vice-versa to enable the weaving yarn to be laid through the array of longitudinal yarn, the first means being capable of supporting the arm beyond one side of the array and the second means being capable of supporting the arm beyond the other side of the array, each support means rotating the arm as it transfers the arm through the array to the other support means, with the rotation being about an axis located to the side of the array, each support means including a rotatable shaft, means for rotating the shaft, and a latching mechanism on the shaft with the latching mechanism being capable of engaging and releasing the transfer arm, and having at least one pin offset from the axis of the rotatable shaft and configured to project into the transfer arm and means for moving the offset pin into engagement with the transfer arm and for retracting it from the transfer arm.

6. A machine according to claim 5 wherein the means for moving the offset pin includes a center shaft extended through the rotating shaft, a flange on the center shaft, the flange being located beyond the end of the rotating shaft and having the offset pin thereon, and means for moving the center shaft through the rotatable shaft.

7. A machine for inserting cross yarns through an array of longitudinal yarns, said machine comprising: a transfer arm longer than the width of the array and having a supply of yarn on it with the yarn being suitable for use as the cross yarns; first and second support means capable of engaging and releasing the transfer arm and cooperating to transfer the arm between said means such that the arm passes through the array as it is transferred from the first means to the second means and vice-versa to enable the weaving yarn to be laid through the array of longitudinal yarn as a cross yarn therein, the first means being capable of supporting the arm beyond one side of the array and the second means being capable of supporting the arm beyond the other side of the array, each of the support means rotating the arm as it transfers the arm through the array to the other support means with the rotation being about an axis located to the side of the array; and means for moving the transfer arm in the direction of the longitudinal yarn when the transfer arm is extended through the array of longitudinal yarns so as to pack the cross yarn against previously laid cross yarns.

8. A machine according to claim 7 wherein the axes about which the first and second means rotate are parallel to each other and generally perpendicular to the direction of the longitudinal yarns.

9. A machine for inserting cross yarns through an array of longitudinal yarns, said machine comprising: a transfer arm longer than the width of the array and having a supply of yarn on it with the yarn being suitable for use as the cross yarns; first and second support means capable of engaging and releasing the transfer arm and cooperating to transfer the arm between said means such that the arm passes through the array as it is transferred from the first means to the second means and vice-versa to enable the weaving yarn to be laid through the array of longitudinal yarn as a cross yarn therein, the first means being capable of supporting the arm beyond one side of the array and the second means being capable of supporting the arm beyond the other side of the array, both the first and second means being capable of engaging the transfer arm simultaneously with the arm being extended through the array of longitudinal yarns when so engaged, each of the support means rotating the arm as it transfers the arm through the array to the other support means with the rotation being about an axis located to the side of the array; and a yoke on which the first and second support means are mounted and means for moving the yoke parallel to the longitudinal yarns while the transfer arm is engaged with both of the support means so as to pack the most recently laid cross yarn against previously laid cross yarns.

10. A machine for inserting cross yarns through an array of longitudinal yarns, said machine comprising: a transfer arm longer than the width of the array and having a supply of yarn on it with the yarn being suitable for use as the cross yarns; first and second support means capable of engaging and releasing the transfer arm and cooperating to transfer the arm between said means such that the arm passes through the array as it is transferred from the first means to the second means and vice-versa to enable the weaving yarn to be laid through the array of longitudinal yarn as a cross yarn therein, the first means being capable of supporting the arm beyond one side of the array and the second means being capable of supporting the arm beyond the other side of the array, each of the support means rotating the arm as it transfers the arm through the array to the other support means with the rotation being about an axis located to the side of the array; and a yoke on which the first and second support means are mounted, and means for rotating the yoke 90° to enable the transfer arm to insert the weaving yarn through the array of longitudinal yarns perpendicular to the cross yarns inserted in the other position for the yoke.

11. A machine for inserting cross yarns through an array of longitudinal yarns, said machine comprising: a yoke; a pair of rotatable shafts mounted on the yoke generally perpendicular to the array of longitudinal yarns; a transfer arm which is long enough to extend completely through the array and span the space between the rotatable shafts; a supply of weaving yarn on the transfer arm, the weaving yarn being suitable for use as cross yarns; a latching mechanism on each rotatable shaft with each latching mechanism being capable of individually engaging and releasing the transfer arm, whereby the transfer arm may be secured to either one or both of the rotatable shafts; means connected to each shaft for rotating the arm from a traversing position, wherein it extends through the array of longitudinal yarns and spans the space between the two rotatable shafts, to an end position, wherein the transfer arm is located entirely to the side of the longitudinal array; and means for moving the yoke toward and away from the array of longitudinal yarns generally perpendicular to the direction in which the longitudinal yarns extend.

12. A machine according to claim 11 wherein each latching mechanism comprises a backing flange or the end of the rotating shaft with which the latching mechanism is associated, a center shaft extended through the rotatable shaft, means for moving the center shaft axially with respect to the rotatable shaft, and a pin carried by the center shaft in offset relation to the axis of the center shaft for engaging the transfer arm to enable the rotatable shaft to rotate the transfer arm.

13. A machine for inserting cross yarns through an array of longitudinal yarns, said machine comprising: a yoke; a pair of rotatable shafts mounted on the yoke generally perpendicular to the array of longitudinal yarns; a transfer arm which is long enough to extend completely through the array and span the space between the two rotatable shafts; a supply of weaving yarn on the transfer arm, the weaving yarn being suitable for use as cross yarns; a latching mechanism on each rotatable shaft with each latching mechanism being capable of individually engaging and releasing the transfer arm, whereby the transfer arm may be secured to either one or both of the rotatable shafts; means connected to each shaft for rotating the arm from a traversing position, wherein it extends through the array of longitudinal yarns and spans the space between the two rotatable shafts, to an end position, wherein the transfer arm is located entirely to the side of the longitudinal array; and means for moving the yoke generally parallel to the direction of the longitudinal yarns while the transfer arm is engaged with the two latching mechanisms so as to pack the most recently laid cross yarn against cross yarns which have previously been laid and packed.

14. A machine for inserting cross yarns through an array of longitudinal yarns, said machine comprising: a yoke; a pair of rotatable shafts mounted on the yoke generally perpendicular to the array of longitudinal yarns; a transfer arm which is long enough to extend completely through the array and span the space between the two rotatable shafts; a supply of weaving yarn on the transfer arm, the weaving yarn being suitable for use as cross yarns; a latching mechanism on each rotatable shaft with each latching mechanism being capable of individually engaging and releasing the transfer arm, whereby the transfer arm may be secured to either one or both of the rotatable shafts; means connected to each shaft for rotating the arm from a traversing position; wherein it extends through the array of longitudinal yarns and spans the space between the two rotatable shafts, to an end position, wherein the transfer arm is located entirely to the side of the longitudinal array; and a yarn laying arm pivotally connected to the transfer arm generally midway between the ends of the transfer arm and having a free end located remote from the pivotal connection with the transfer arm, the yarn laying arm being shorter than the transfer arm with its free end serving as a guide for the weaving yarn; and actuating means for rotating the yarn laying arm about its pivotal connection to the transfer arm as the transfer arm rotates from each end position to its traversing position with the rotation being such that the free end moves from the end position at which the transfer arm is initially located to the other end position, laying the weaving yarn through the array longitudinal yarn in the form of a cross yarn as it does.

15. A machine according to claim 14 wherein the laying arm pivots relative to the transfer arm about an axis which is parallel to the axes of the two rotatable shafts.

16. In combination with a first machine for creating shed openings in an array of longitudinal yarns with the longitudinal yarns bounding each shed opening converging toward an apex at the front of the shed opening, a second machine for inserting a weaving yarn through the shed opening created in the array by the first machine, said second machine comprising: a transfer arm longer than the width of the array; first and second support means for simultaneously engaging and jointly supporting the transfer arm when the transfer arm is in a traversing position wherein it extends completely through a shed opening in the array, each support means further being capable of moving the transfer arm to an end position wherein it is located entirely at the side of the array and supporting the transfer arm at that side of the array, the first support means supporting the transfer arm at one side of the array and the second support means supporting the transfer arm at the other side of the array; mounting means on the transfer arm for supporting a supply of weaving yarn suitable for use as the cross yarns, with the supply being located generally behind the transfer arm and away from the apex in the array when the transfer arm is in its traversing position; and yarn laying means mounted on the transfer arm for movement relative to the transfer arm such that the weaving yarn is directed into the shed opening as the transfer arm moves from the first supporting means to the second supporting means and vice-versa, the yarn laying means having a free end from which the weaving yarn is dispensed into the shed opening of the array and the free end being presented ahead of the transfer arm and projected generally toward the apex of the shed opening as the transfer arm moves from the first support means to the second support means and vice-versa to enable the weaving yarn to be laid quite close to the apex of the shed opening and thereby add another cross yarn to the array of longitudinal yarns.

17. The combination according to claim 16 and further comprising means for moving the transfer arm forwardly toward the apex of the shed opening when the transfer arm is in its traversing position so as to pack the most recently laid cross yarn against previously laid cross yarns.

18. The combination according to claim 16 wherein the yarn laying means comprises a yarn laying arm which pivots on the transfer arm intermediate the ends of the transfer arm and has a free end from which the weaving yarn is discharged into the array, and activating means for rotating the yarn laying arm about its pivotal connection with the transfer arm as the transfer arm moves from one end position to the other such that the free end of the yarn laying arm moves from the end position at which the transfer arm is initially located to the other end position to which the transfer is transferred, laying the weaving yarn through the array in the form of a cross yarn as it does.

* * * * *